United States Patent [19]

Nasca

[11] Patent Number: 4,601,673

[45] Date of Patent: Jul. 22, 1986

[54] ARTIFICIAL EYE

[76] Inventor: Gayle L. Nasca, 1060 Rossmore Ave., Baton Rouge, La. 70810

[21] Appl. No.: 623,516

[22] Filed: Jun. 22, 1984

[51] Int. Cl.[4] ..... A63H 3/38

[52] U.S. Cl. ..... 446/389; 446/392; 623/4

[58] Field of Search ..... 446/389, 392, 27, 219; 3/13; 623/4, 5

[56] References Cited

U.S. PATENT DOCUMENTS

| | | | |
|---|---|---|---|
| 1,037,473 | 9/1912 | Gruenberger | 446/27 |
| 1,253,888 | 1/1918 | Rosser . | |
| 1,763,312 | 6/1930 | Marcus | 446/389 |
| 1,782,818 | 11/1930 | Grubman | 446/389 |
| 1,993,121 | 3/1935 | Travers | 3/13 |
| 2,161,878 | 6/1939 | Marcus | 446/389 |
| 2,394,400 | 2/1946 | Noles | 3/13 |
| 2,466,278 | 4/1949 | Rupert | 46/165 |
| 2,903,816 | 9/1959 | Fox | 46/1 |
| 2,991,588 | 7/1961 | Williams | 46/165 |
| 3,846,199 | 11/1974 | Cappelli | 3/13 X |
| 4,324,066 | 4/1982 | Smith et al. | 46/165 |
| 4,393,619 | 7/1983 | Murch | 446/392 |

*Primary Examiner*—Mickey Yu

*Attorney, Agent, or Firm*—Pravel, Gambrell, Hewitt & Kimball

[57] ABSTRACT

An artificial eye including a sclera for insertion into an eye socket, the sclera having a cavity therein for forming the pupil of the eye, the sclera being made from a soft, elastic material, and a transparent cornea connected to the sclera. The sclera and cornea are encapsulated by a transparent, resilient and elastic coating to define an integral unit.

17 Claims, 11 Drawing Figures

ARTIFICIAL EYE

BACKGROUND OF THE INVENTION

1. Field of the Invention

The present invention relates to artificial eyes and in particular to artificial eyes for use in toys, such as dolls, and for use in mannequins. More particularly, the present invention relates to an artificial eye which is soft, elastic and human in appearance, and which can be deformed sufficiently for insertion in the rigid eye socket of a doll or a mannequin from the front of the eye socket.

2. Description of the Prior Art

Artificial eyes are well known in the prior art. Artificial eyes are used for dolls, toys, mannequins and by persons who have lost an eye. Exemplary of artificial eyes disclosed in the prior art are the following:

U.S. Pat. No. 4,324,066 discloses an artificial eye comprising an opaque, bulbous base and a convex, rigid, substantially transparent lens secured to the base. Between the lens and the base is an image of an eye, the image being visable through the lens. The lens is secured to the base by a film of substantially transparent polymeric material. For durability, the base, cap, and film are all formed from rigid plastic materials that are substantially unbreakable in use.

U.S. Pat. No. 2,991,588 discloses an eye for toys, the eye including an iris portion having an aperture therethrough and a pupil portion having a threaded stem. The threaded stem passes through an aperture and a nut is threaded on the stem for maintaining the pupil portion in a stationary position relative to the iris portion. The iris and pupil are rigid plastic materials such as nylon and polystyrene.

U.S. Pat. No. 2,903,816, discloses an amusement device including an artificial eye having a suction cup at the rear thereof for placement on a flat surface such as the forehead of the human body. The general configuration is such as to imitate the bulbousness of that portion of a person's features immediately surrounding an eye, showing the lid and the lashes. The eye portion of the eye assembly is a button received in a cavity molded in the body containing the eye. A surface surrounding the eye is colored white to represent the white of the eye.

U.S. Pat. No. 2,466,278 discloses a plastic doll's eye and method of making the eye. The eyeball or sclera is made of cellulose acetate butyrate and is rigid and non-elastic. A cornea is made of the same material and is inserted in a cavity or recess in the eyeball. A pin is connected to the rear of the eyeball for connecting the eye to a doll.

U.S. Pat. No. 2,394,400 discloses a method of making an artificial eye for the human body. The portion of the eye corresponding to the sclera is formed from a rigid plastic material such as phenol. The sclera has a recess for a receipt of an iris.

U.S. Pat. No. 1,993,121 discloses an artificial eye for the human body made from a thermoplastic material such as a polymerized olefine derivative. The plastic from which the material is made is rigid plastic and is not flexible or elastic.

U.S. Pat. No. 1,253,888 discloses an artificial eye made from hardened white rubber and having a glass iris. The body is formed of hardened rubber and is not flexible or elastic.

Artificial eyes presently on the market are commonly made of glass and are very expensive. Furthermore, such glass eyes must be inserted into a doll's eye socket from the back side of the doll, thus requiring opening the skull of the doll prior to fitting the eye therein.

Difficulty is frequently encountered in fitting glass eyes into the eye socket of a doll due to slight variations in the dimensions of the eye socket and glass eye during manufacture, or warpage of the eye socket after manufacture. To fit a glass eye into such eye sockets, it is frequently necessary to cut or bevel each socket to fit the eye.

When glass eyes are utilized in porcelain dolls, the inside portion of the eye socket must be perfectly cut and sized in the greenware stage of manufacture of the doll, and such cutting and sizing requires expensive, time consuming, expert craftsmanship. Furthermore, when greenware is fired, warping sometimes occurs, and a glass eye will not fit in the eye socket without additional time consuming and expensive cutting and beveling of the eye socket.

It is an object of this invention to provide a low cost artificial eye which closely resembles the human eye.

It is another object of the invention to provide an elastic, life-like human eye which can be deformed and fitted into the rigid eye socket of a doll, thereby conforming naturally to the entire contour of the rigid eye socket without the necessity of precisely shaping the socket to fit the eye.

An additional object of this invention is to provide an elastic, life-like human eye which can be deformed and fitted into the rigid eye socket of a doll from the front of the eye socket.

SUMMARY OF THE INVENTION

In accordance with the present invention there is provided an artificial eye including a sclera for insertion into an eye socket, the sclera having a cavity therein for forming the pupil of the eye, the sclera being made from a soft, elastic material, and a transparent cornea connected to the sclera. The cornea may have a pigment therein to color the cornea. In a preferred embodiment of the invention, the sclera has a recessed portion for receipt of the cornea and/or an iris. In another additional embodiment of the invention, the artificial eye includes a sclera with a recessed portion and a reflective material connected to the recessed portion, an iris having striations therein located adjacent to the reflective material, and a cornea adjacent to the iris. In a further embodiment of the invention the sclera has a recessed portion for receipt of a reflective material and a colored cornea. Additional embodiments will be disclosed below.

The artificial eyes of the invention have the advantage of very closely resembling the human eye. Another advantage of the artificial eye of the invention is that the eye is relatively inexpensive to manufacture as compared to glass eyes and other eyes of the prior art.

An even further advantage of the present invention is that it is possible for the eye to be deformed by the fingers of the craftsman and inserted into the front of a rigid eye socket in a doll, thus allowing the skull of the doll to be molded as one piece without requiring that the skull be opened to insert the eye from the back of the eye socket.

A further important advantage of the elastic eye of the invention is that the eye can be inserted into the eye sockets of dolls and mannequins made of porcelain or other hard materials without the necessity precisely forming and shaping the socket to fit the eye.

BRIEF DESCRIPTION OF THE DRAWINGS

The invention will be more readily understood by reference to the drawings in which.

DESCRIPTION OF THE PREFERRED EMBODIMENTS

Figure 1:
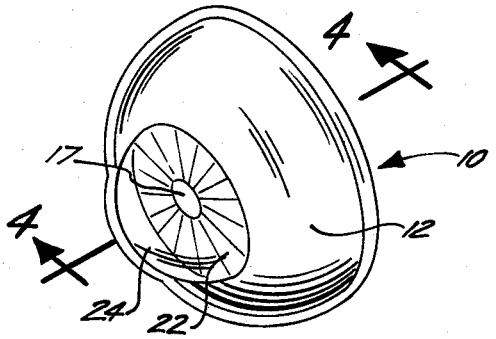
FIG. 1 is a perspective view of an assembled artificial eye of the invention.

Referring now to the drawings, FIGS. 1 through 6 show a preferred embodiment of the invention. The completely assembled eye is generally indicated by the numeral 10. The eye has a body 12 in the shape of a truncated hemisphere which corresponds roughly to the sclera of the human eye. The body 12 will hereinafter be referred to as sclera 12. The sclera 12 has a circular bottom or base 13, a recessed portion 14 in the top side thereof and a cylindrical cavity 16 extending completely therethrough which defines an opening 17. The recessed portion 14 is generally cylindrical in shape, having side walls 18 and a flat base 20.

The hemispherical sclera 12 is preferably made from a soft, elastic, skin-like material such as polyvinyl chloride, silicone, or the like. Plasticizers may be added as desired to achieve the desired degree of elasticity and softness. Room temperature vulcanizable (RTV) silicone is preferred. The material is preferably white in color and is translucent or semi-translucent to closely resemble the white portion or sclera of the human eye.

Preferably sclera 12 is sufficiently soft and elastic so that the base 13 may be reduced in diameter to two-thirds, or more preferably one-half, or most preferably one-third of its original maximum outside diameter, and then will return to its original shape. Such flexibility and elasticity is important for ease of installation into the eye sockets of dolls utilizing the eye of the present invention. Furthermore, the flexibility and elasticity of sclera 12 enables the eye of the invention to conform readily to a variety of eye socket shapes and to any irregularities found therein.

Figure 2:
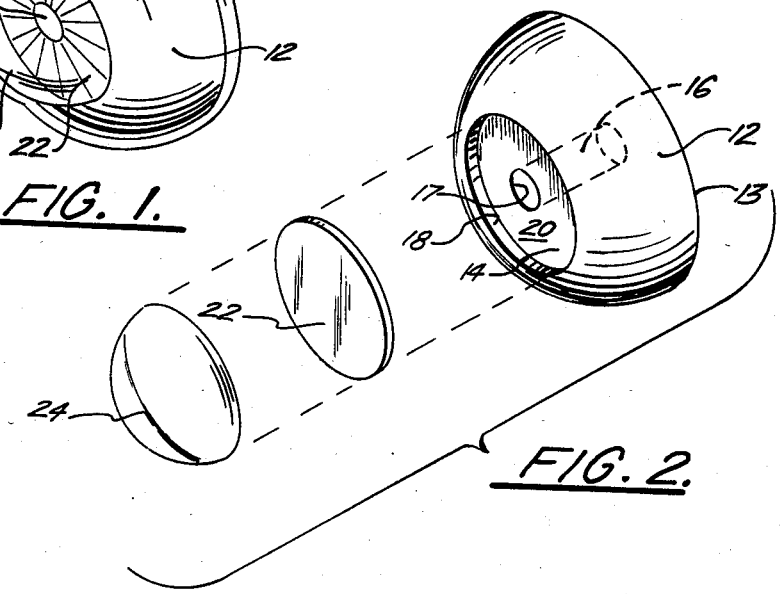
FIG. 2 is an exploded perspective view of an eye of the present invention.
Figure 3:
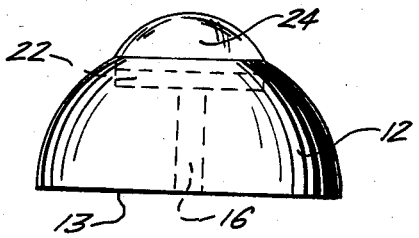
FIG. 3 is a side view of an eye of the invention.
Figure 4:
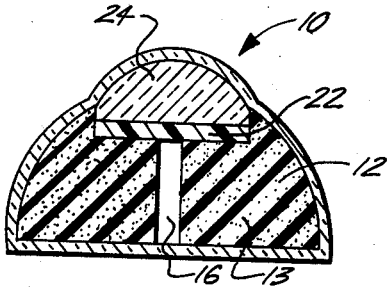
FIG. 4 is a cross-sectional view of the eye shown in FIG. 1 taken along lines 4—4 of FIG. 1.

As shown in FIGS. 2 through 4, a flat cylindrical disc 22 is received in recessed portion 14. Disc 22 roughly corresponds to the iris of the human eye, and will hereinafter be referred to as iris 22. Preferably iris 22 has no hole in the center thereof, although a hole aligned with cavity 16 may be located in iris 22 if desired.

Iris 22 is pigmented or colored as is the iris of the human eye. Any color may be selected for iris 22 as desired for the iris of the doll's eye. Iris 22 is preferably made from a transparent or translucent flexible plastic material such as polyvinyl choride, silicone or the like, although iris 22 could be glass or a rigid plastic material containing the desired pigmentation.

Figure 8:
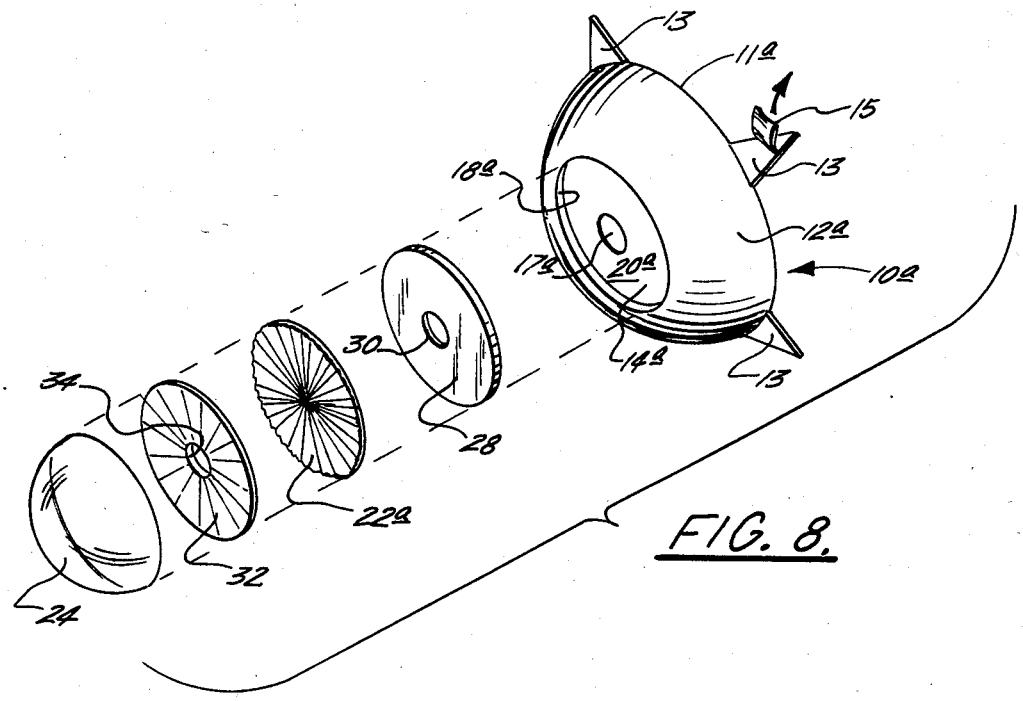
FIG. 8 is a perspective, exploded view of another embodiment of the invention.

If desired the top or bottom of iris 22 could be striated as shown at **22*a* in FIG. 8. Such striations give eye 10 an appearance which may be desired in some applications mimicking the natural striae in the human eye and reflecting light on the striae or ridges in iris 22**.

Also located in recessed portion 14 is a clear hemispherical member 24 corresponding to the cornea of the human eye. Member 24 will be hereinafter referred to as cornea 24. Cornea 24 is preferably transparent, as is the cornea of the human eye, and is not colored or pigmented.

If desired, the base 20 of recessed portion 14 could be painted a desired color, and iris 22 could be eliminated. Transparent cornea 24 could then be placed in recessed portion 14.

Also, if desired, cornea 24 could be colored or pigmented and iris 22 could be eliminated. When cornea 24 contains the coloring for the eye, the eye would appear at a distance to be similar to the coloring given the human eye by the iris.

Figure 5:
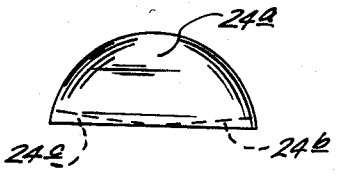
FIG. 5 is a side elevational view of a cornea of the invention.
Figure 6:
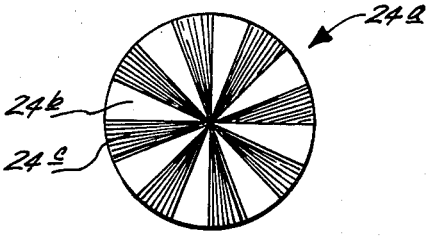
FIG. 6 is a bottom view of the cornea shown in FIG. 5.

If desired, the cornea indicated in FIG. 5 as **24*a* could be substituted for cornea 24. Cornea 24*a* has a series of triangular striations 24*b* and 24*c* which form a series of prisms in the bottom of cornea 24*a* which reflect light in a way which may be desirable in some dolls. Thus the striated cornea 24*a* could be utilized with sclera 12 without utilizing the pigmented disc 22**.

After the disc 22 is placed into recessed portion 14, cornea 24 is placed on top of disc 22 as shown in FIG. 3. The assembled eye shown in FIG. 3 is then preferably coated or encapsulated with a transparent plastic material such as that from which hemispherical sclera 12 is made, silicone being preferred. The coating forms a layer 26 which completely encapsulates the eye as shown in FIG. 4. Layer 26 is soft, resilient and skin-like material such as that from which sclera 12 is made. As shown in FIGS. 2 and 4, the cornea 24 occupies the recessed top 14 with the cornea 24 abutting the annular side wall 18, thus defining an annular seam on the outer surface of the eye 10. Since the layer 26 completely encapsulates (preferred) the eye 10 (FIG. 4), the layer 26 also seals the annular seam, discouraging separation of cornea 24 and sclera 12 during installation or use. A child, for example, can squeeze or "feel" the flexible eye 10 without dislodging cornea 24 from sclera 12.

Figure 7:
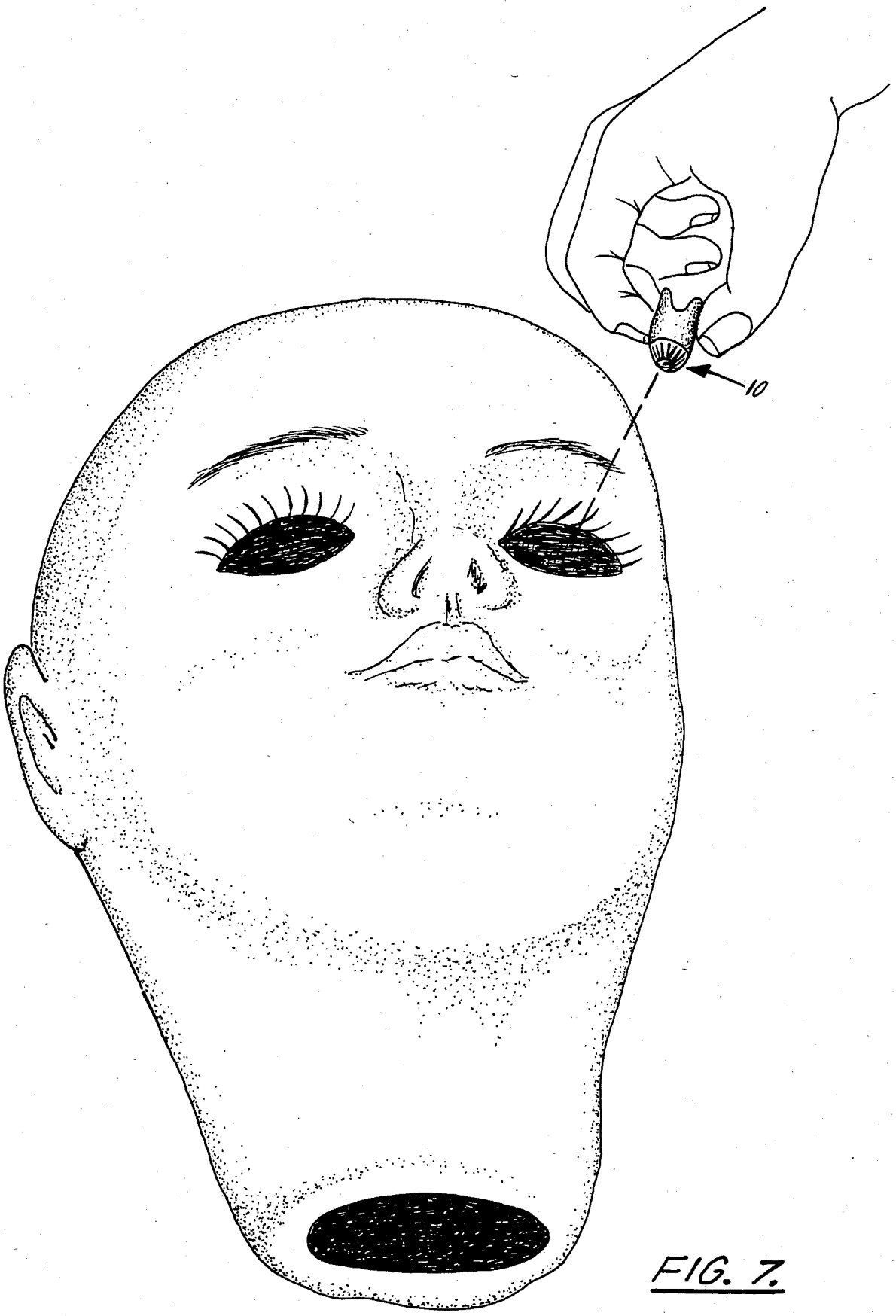
FIG. 7 is a perspective view showing the insertion of the eye of the invention into the front of a eye socket.

The embodiment of the eye shown in FIGS. 1 through 6 has a life-like appearance which is greatly enhanced by the hollow cavity 16 which forms the pupil of eye 10 in a manner very similar to the human eye. As shown in FIG. 7, eye 10 may be squeezed together by the fingers of a craftsman for easy insertion from the front in the eye socket of a doll. After insertion in the eye socket, the elastic eye will attempt to regain its former shape, thereby binding the eye in the socket. Thus, with the eye of the present invention, it is not necessary for the skull of the doll to be opened to insert the eye. Dolls utilizing the eye of the invention can be formed with a one-piece solid skull having sockets for receipt of the flexible eye of the invention.

If the doll is made with a hollow head, the eye 10 can be inserted through the neck or opening in the top of the skull in the same manner in which conventional rigid eyes such as glass eyes are inserted into doll eye sockets.

The eye 10 of the invention will readily conform to the eye socket and will not require tedious shaping of the eye socket to fit the eye as is common when fitting glass eyes or other rigid eyes in dolls.

Figure 9:
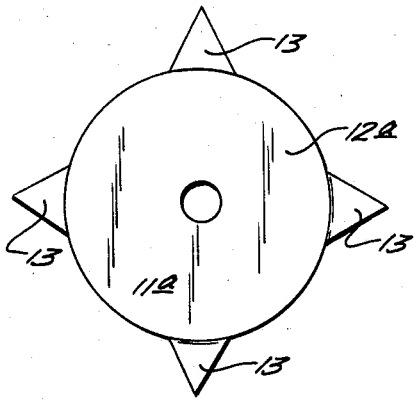
FIG. 9 is a bottom view of the eye shown in FIG. 8.
Figure 10:
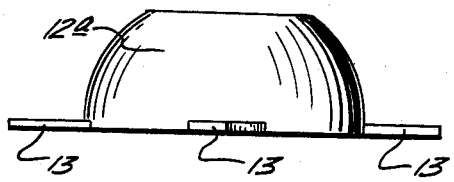
FIG. 10 is a side elevational view of the sclera shown in FIG. 8.

In FIGS. 8 through 10 is shown another embodiment of the invention. The eye generally indicated by the numeral 10*a has a sclera 12a* having a circular bottom or base 11*a*. Sclera 12*a* may have integrally molded therewith a series of tabs 13. Tabs 13 assist in holding eye 10*a* in the eye socket of a doll. The tabs may vary in number although at least three are preferred.

In the embodiment shown in FIG. 8, a protective strip 15 is connected to the surface of tab 13. Protective strip 15 can be utilized to cover and protect an adhesive placed on the surface of tab 13. The adhesive may be used to assist in securing the tabs to the inside of the eye socket in a doll.

Eye 10*a* has a recessed portion 14*a* with sidewalls 18*a* and base 20*a* identical to the previously described elements. 14, 17, 18 and 20. Similarly, eye 10*a* can be fitted with a cornea 24 corresponding to cornea 24 and an iris similar or identical to disc 22 previously described.

A preferred striated iris 22*a* is shown in FIG. 8. Iris 22*a* can be seen to have a series of striae thereon which are similar to the striae shown in the bottom of cornea 24*a* in FIGS. 5 and 6. Such striations give eye 10 an appearance which may be desired in some applications.

In FIG. 8 is shown an additional element 28 which may also be utilized with the eye 10*a* previously described. Element 28 is an opaque reflective material such as a decal having a reflective mirror surface placed in recessed portion 14*a* to give greater reflection of light upwardly through iris 22*a* and cornea 24. Decal 28 has a hole 30 in the center thereof which is aligned with pupil 17*a* and eye 10*a* or is aligned with pupil 17 and eye 10. Preferably, the upper surface of decal 28 has the reflective, mirror-like surface and the lower surface has an adhesive material connected thereto which will adhere to flat base 20*a* of recessed portion 14*a*. Reflective disc 28 could also be utilized with cornea 24*a* shown in FIGS. 5 and 6.

Figure 11:
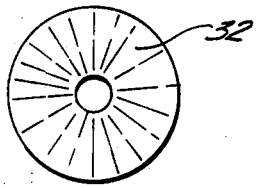
FIG. 11 is a top plan view of a decal shown in FIG. 8.

Also shown in FIGS. 8 and 11 is a transparent decal 32 have a hole 34 therein equal in size and axially aligned with holes 30 and 17*a*. Decal 32 is preferably located between iris 22*a* and cornea 24*a*. A series of dark lines radiating or drawn from the center of decal 30 outwardly are imprinted on the decal. The lines in decal 30 are of random length and closely resemble the radial lines in the iris of the human eye, thereby giving eye 10*a* an even more life-like appearance.

The sclera 12 shown in FIG. 2 could of course be substituted for the sclera 12*a* shown in FIG. 8. Furthermore, both sclera 12 and 12*a* may be attached to an eye socket by glue or other desired adhesives. Also, if desired, decal 32 or decal 28 could be omitted from the eye assembly shown in FIG. 8.

Summarizing the various elements present in the embodiments of the invention, the eye assembly of the invention may include:

A. Sclera 12 or 12*a* and colored cornea 24 or 24*a;*

B. Sclera 12 or 12*a*, decal 28, and colored cornea 24 or 24*a;*

C. Sclera 12 or 12*a*, iris 22, and clear cornea 24 or 24*a;*

D. Sclera 12 or 12*a*, decal 28, iris 22, and clear cornea 24 or 24*a;*

E. Sclera 12 or 12*a*, decal 28, iris 22, decal 32, and cornea 24 or 24*a;*

F. Sclera 12 or 12*a*, iris 22*a*, and clear cornea 24;

G. Sclera 12 or 12*a*, decal 28, iris 22*a*, and clear cornea 24;

H. Sclera 12 or 12*a*, decal 28, iris 22*a*, decal 32, and clear cornea 24.

Of the above embodiments, embodiment G is the preferred embodiment H is the most preferred.

Although the preferred embodiments of the present invention have been disclosed and described in detail above, it should be understood that the invention is in no sense limited thereby, and its scope is to be determined by that of the following claims.

What is claimed is:

1. An artificial eye for toy dolls with open eye sockets comprising:

a. sclera means for insertion into one of the eye sockets, and sclera means having a recessed portion with a peripheral edge wall therein for receiving a cornea, said sclera means being made from a soft, resilient, elastic material that can conform to the eye socket of the doll;

b. an annular, transparent cornea connected to said sclera by occupying the recessed portion and abutting the peripheral edge wall of the recessed portion thereby defining an annular seam between the sclera means and the cornea;

c. transparent, resilient and elastic, flexible coating means for encapsulating the combination of the cornea and sclera means so that the seam is covered by the coating means, the combination of the sclera means, cornea and coating means defining a soft, pliable, elastic unit.

2. The artificial eye of claim 1 wherein said recessed portion is cylindrical in shape.

3. The artificial eye of claim 1 wherein the sclera is a white silicone body.

4. The artificial eye of claim 1 wherein said sclera means has the shape of a truncated hemisphere.

5. The artificial eye of claim 4 wherein said sclera means has a circular base.

6. The artificial eye of claim 1 wherein the coating means is a layer of silicone.

7. The artificial eye of claim 1 wherein said cornea means is colored.

8. The artificial eye of claim 1 wherein said recessed portion has a circular base means.

9. The artificial eye of claim 8 wherein said circular base means of said recessed portion is colored.

10. The artificial eye of claim 1 further comprising iris means located in said recessed portion between said cornea and said sclera means.

11. The artificial eye of claim 10 wherein said iris means is colored.

12. The artificial eye of claim 11 wherein said iris means is translucent.

13. The artificial eye of claim 11 wherein said iris means is transparent.

14. The artificial eye of claim 11 wherein said iris means is striated.

15. The artificial eye of claim 11 wherein reflective means is located between said iris means and said base means of said recessed portion for reflecting light through said iris means and said cornea means.

16. The artificial eye of claim 15 wherein transparent decal means is located between said cornea means and said iris means, said decal means having imprinted thereon a plurality of opaque lines radiating from the center of said decal outwardly.

17. An artificial eye for toy dolls with open eye sockets comprising in combination:

a. soft, resilient, elastic sclera means for insertion into one of the eye sockets, said sclera means having a generally cylindrical recessed portion therein, said recessed portion having a generally circular base and a peripheral edge wall, for receiving a cornea;

b. generally circular iris means located in said recessed portion of said sclera means, said iris means being colored, c. transparent cornea means connected to said iris means and said sclera means, by occupying the recessed portion of the sclera and communicating with the peripheral edge wall thereby defining an annular seam between the sclera means and the cornea means; and d. transparent, resilient and elastic coating means for encapuslating the combination of the cornea means and sclera means so that the seam is covered by the coating means.

* * * * *